US006503444B1

(12) United States Patent
Andersson

(10) Patent No.: US 6,503,444 B1
(45) Date of Patent: Jan. 7, 2003

(54) HIGH DENSITY SOFT MAGNETIC PRODUCTS AND METHOD FOR THE PREPARATION THEREOF

(75) Inventor: Ola Andersson, Nyhamnsläge (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 09/963,633

(22) Filed: Sep. 27, 2001

(30) Foreign Application Priority Data

Jun. 19, 2001 (SE) ..... 0102103

(51) Int. Cl.[7] ..... B22F 3/08; C22C 33/02

(52) U.S. Cl. ..... 419/48; 419/36; 419/38; 419/66

(58) Field of Search ..... 419/38, 36, 66, 419/48

(56) References Cited

U.S. PATENT DOCUMENTS

| | | | |
|---|---|---|---|
| 3,245,841 | A | 4/1966 | Clarke et al. |
| 4,602,957 | A | 7/1986 | Pollock et al. |
| 4,947,065 | A | 8/1990 | Ward et al. |
| 5,198,137 | A | 3/1993 | Rutz et al. |
| 5,798,177 | A | 8/1998 | Jansson |
| 6,202,757 | B1 | 3/2001 | Dahlberg |

FOREIGN PATENT DOCUMENTS

| | | | |
|---|---|---|---|
| DE | 3439397 | C2 | 1/1990 |
| EP | 0 331 285 | A2 | 9/1989 |
| EP | 0 331 286 | A2 | 9/1989 |
| WO | WO 96/30144 | A1 | 10/1996 |
| WO | WO 97/30810 | A1 | 8/1997 |

*Primary Examiner*—Daniel J. Jenkins
(74) *Attorney, Agent, or Firm*—Burns, Doane, Swecker & Mathis, LLP

(57) ABSTRACT

The invention concerns a method of preparing high density compacts for soft magnetic applications comprising the steps of subjecting an iron or iron-based soft magnetic powder the particles of which are electrically insulated to compaction in an uniaxial pressure operation with a ram speed of at least 2 m/s.

20 Claims, 3 Drawing Sheets

Figure 1:
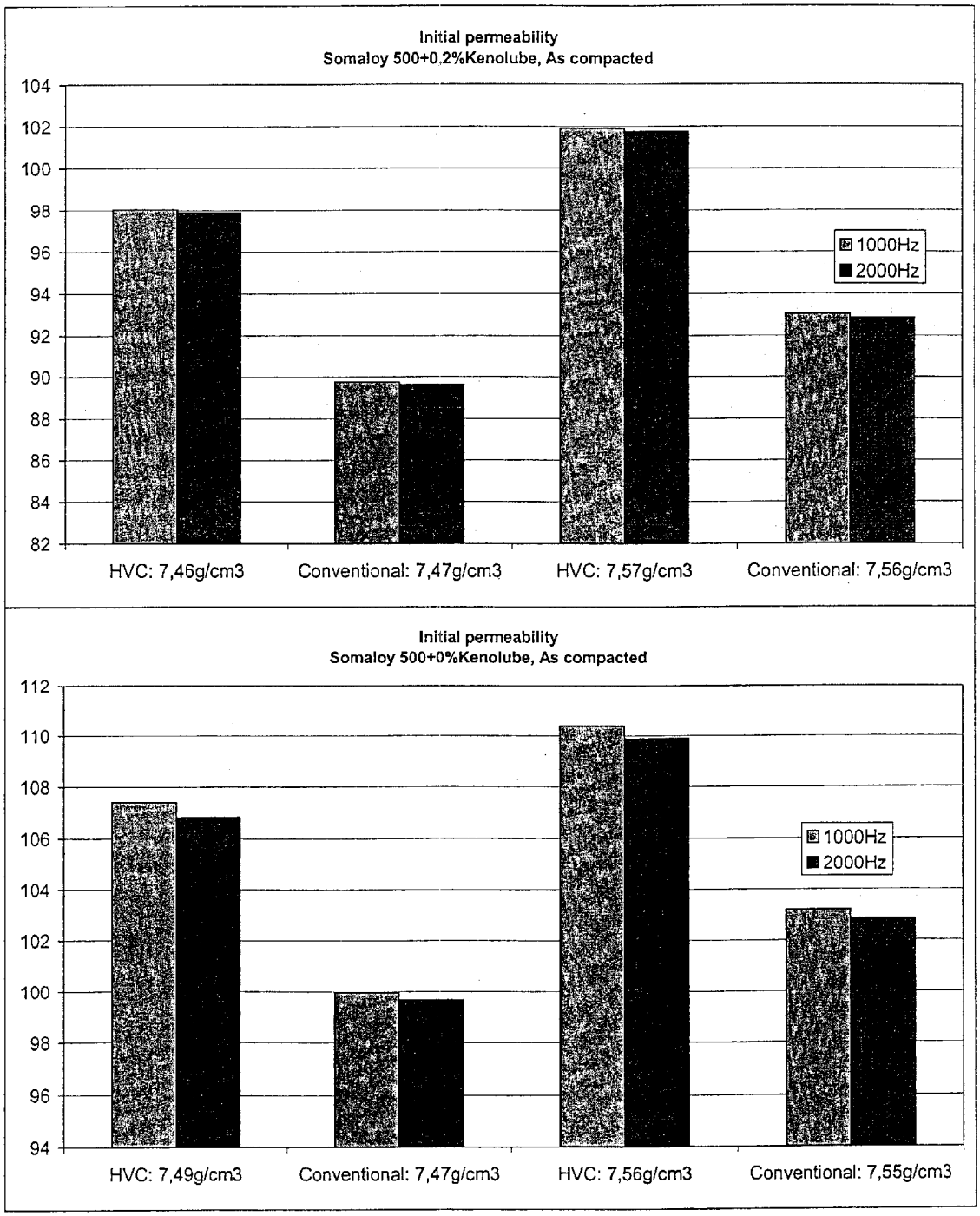

Initial permeability vs. frequency ABC 100.30 0,2 % Green, with DWL

Initial permeability vs. frequency ABC 100.30 0,5 % Green, no DWL

HIGH DENSITY SOFT MAGNETIC PRODUCTS AND METHOD FOR THE PREPARATION THEREOF

This application claims priority under 35 U.S.C. §§119 and/or 365 to Application No. 0102103-9 filed in Sweden on Jun. 13, 2001; the entire content of which is hereby incorporated by reference.

FIELD OF THE INVENTION

This invention relates to the general field of powder metallurgy. Particularly the invention is concerned with a method of preparation of high density soft magnetic products.

BACKGROUND OF THE INVENTION

In recent years the use of powdered metals for the manufacture of soft magnetic core components has expanded and the research has been directed to the development of iron powder compositions that enhance certain physical and magnetic properties without detrimentally affecting other properties. To this end many efforts have been made in order to provide electrical coatings which insulate the individual iron powder particles and many examples of different coatings are disclosed in the art.

Thus according to the U.S. Pat. No. 3,245,841 an insulated powder is prepared by treating an iron powder with a coating solution including phosphoric acid and chromic acid. Insulating coatings are also described in e.g. U.S. Pat. No. 5,798,177 and DE 34 39 397. According to these publications the coatings are obtained by treating iron based powders with coating solutions including phosphoric acid. The compacted product prepared from the insulated powders is subsequently heat treated. Another type of coating is disclosed in U.S. Pat. No. 4,602,957. According to this patent a magnetic powder core is prepared by treating an iron powder with an aqueous solution of potassium dichromate, drying the powder, compressing the powder to form a compact and heat treating the compact at substantially 600° C. In other known processes soft iron particles are coated with thermoplastic materials before pressing. The U.S. Pat. Nos. 4,947,065 and 5,198,137 teach such methods whereby iron powders are coated with a thermoplastic material. A more recent method of coating iron-based powders for soft magnetic applications is described in PCT SE97/00283. Thus by using different types of coatings and coating techniques desired properties such as high permeability through an extended frequency range, high pressed strength, low core losses and suitability for compression moulding techniques have been considerably improved lately.

It has now been found that the magnetic properties, such as the initial permeability as a function of the frequency (frequency stability), may be improved by using a high velocity compaction (HVC) technique, which is described more in detail below. Especially unexpected is the finding that, for a given density, the initial permeability at different frequencies are significantly higher with this HVC technique and that these properties have been observed for both insulated and not insulated powder particles.

OBJECTS OF THE INVENTION

An object of the invention is to provide a method for the preparation of high density soft magnetic products, particularly products having a density above 7.25, preferably above 7.30 and most preferably above 7.35 g/cm$^3$.

A second object is to provide a compaction method adapted to industrial use for mass production of such high density products.

A third object is to provide compacted bodies having high density and high green strength.

A fourth object is to provide a soft magnetic compacts bodies having high initial permeability.

SUMMARY OF THE INVENTION

In brief the method of preparing such high density compacts comprises the steps of subjecting an iron or iron-based soft magnetic powder to HVC compaction with an uniaxial pressure movement with a ram speed of at least 2 m/s. The particles of powder may, but must not, be electrically insulated.

DETAILED DESCRIPTION OF THE INVENTION

The base powder, i.e. the non-insulated powder, may be a substantially pure water atomised iron powder or a sponge iron powder having irregularly shaped particles. In this context the term "substantially pure" means that the powder should be substantially free from inclusions and that the amounts of the impurities O, C an N should be kept at a minimum. The average particle sizes are generally below 300 $\mu$m and above 10 $\mu$m. Examples of such powders are ABC 100.30, ASC 100.29, AT 40.29, ASC 200, ASC 300, NC 100.24, SC 100.26, MH 300, MH 40.28, MH 40.24 available from Höganäs AB, Sweden.

An insulating coating may be applied in order to improve the properties in alternating magnetic fields. Such a coating also permits heat treatment which further enhances the magnetic properties. The coating and the coating method is believed not to be critical and the coating could e.g. be any of those disclosed above. Especially preferred are thin coatings based on phosphorus and silicone, aluminium and titanium.

In order to obtain the products having the desired high density according to the present invention the compacting method is important. Normally used compaction equipment does not work quite satisfactorily, as the strain on the equipment will be too great. It has now been found that the high densities required may be obtained by the use of the computer controlled percussion machine disclosed in the U.S. Pat. No. 6,202,757 which is which is hereby incorporated by reference. Particularly, the impact ram of such a percussion machine may be used for impacting the upper punch of a die including the powder in a cavity having a shape corresponding to the desired shape of the final compacted component. When supplemented with a system for holding a die, e.g. a conventionally used die, and a unit for powder filling (which may also be of conventional type) this percussion machine permits an industrially useful method for production of high-density compacts. An especially important advantage is that, in contrast to previously proposed methods, this arrangement driven by hydraulics permits mass production (continuous production) of such high density components.

In the U.S. Pat. No. 6,202,757 it is stated that the use of the percussion machine involves "adiabatic" moulding. As it is not fully clarified if the compaction is adiabatic in a strictly scientific meaning and we have used the term high velocity compaction (HVC) for this type of compaction wherein the density of the compacted product is controlled by the impact energy transferred to the powder.

According to the present invention the ram speed should be above 2 m/s. The ram speed is a manner of providing energy to the powder through the punch of the die. No straight equivalence exists between compaction pressure in a conventional press and the ram speed. The compaction which is obtained with this computer controlled HVC depends, in addition to the impact ram speed, i.a. on the amount of powder to be compacted, the weight of the impact body, the number of impacts or strokes, the impact length and the final geometry of the component. Furthermore, large amounts of powder require more impacts than small amounts of powder. Thus the optimal conditions for the HVC compaction i.e. the amount of kinetic energy which should be transferred to the powder, may be decided by experiments performed by the man skilled in the art. Contrary to the teaching in the U.S. Pat. No. 6,202,757 there is, however, no need to use a specific impact sequence involving a light stroke, a high energy stroke and a medium-high energy stroke for the compaction of the powder. According to the present invention the strokes (if more than one stroke is needed) may be essential identical and provide the same energy to the powder.

Experiments with existing equipment has permitted ram speeds up to 30 m/s and, as is illustrated by the examples, high green densities are obtained with ram speeds about 10 m/s. The method according to the invention is however not restricted to these ram speeds but it is believed that ram speeds up to 100 or even up to 200 or 250 m/s may be used. Ram speeds below about 2 m/s does, however, not give the pronounced effect of densification. It is preferred that the ram speed above 3 m/s. Most preferably the ram speed is above 5 m/s.

The compaction may be performed with a lubricated die. It is also possible to include a suitable particular lubricant in the powder to be compacted. Alternatively, a combination thereof may be used. The lubricant can be selected among conventionally used lubricants such as metal soaps, waxes and thermoplastic materials, such as polyamides, polyimides, polyolefins, polyesters, polyalkoxides, polyalcohols. Specific examples of lubricants are zinc stearate, H-waxe® and Kenolube®. The amount of lubricant may vary up to 1% by weight of the powder composition.

The invention is further illustrated by the following examples:

EXAMPLE 1

This example illustrates the possibility of obtaining high initial permeability with a soft magnetic powder (Somaloy 500 available from Höganäs, Sweden), the particles of which are electrically insulated.

100 g powder of the powder were used in a ring tool with the dimensions Ø72/56. Both conventional compaction and HVC compaction were used. The following two mixes were tested:

Somaloy 500+0.2% Kenolube*

Somaloy 500+0% Kenolube*

*Lubricant available from Höganäs AB, Sweden

The compaction machine was Model HYP 35-4 from Hudropulsor Sweden.

The same type of Die Wall Lubrication was used for both mixes and for both compacting methods.

The green density was determined by principle of Archimedes (1).

$$\rho = m_{air}/(m_{air} - m_w) \quad (1)$$

$m_{air}$=mass in air $m_w$=mass in water

The height, inner and outer diameter was measured on each sample. After compaction the toroids were wound with 25 turns of insulated copper wire. The inductance of the coil was measured at 1000 and 2000 Hz with a HP 4284 A LCR-meter. The inductance was measured at low currents (10 mA) and the initial permeability was calculated from (2).

$$\mu_{in} = L*l*10^{-3}/(N^2*A*\mu_0)$$

L=measured inductance in $\mu$Henry l=magnetic length in cm

N=number of turns

A=cross section area in $cm^2$ $\mu_0$=permeability of free space

The samples have the same geometry and testing was made exactly the same way. At a given density an unexpected difference as regards the initial permeability could be observed between HVC and conventional compacted samples as can be seen from FIG. 1. The ram speeds for the HVC compaction were about 7–8 m/s.

EXAMPLE 2

This example illustrates the possibility of obtaining high initial permeability and high frequency stability with a powder (ABC 100.30 available from Höganäs, Sweden), the particles of which are not electrically insulated before the compaction.

Figure 2:
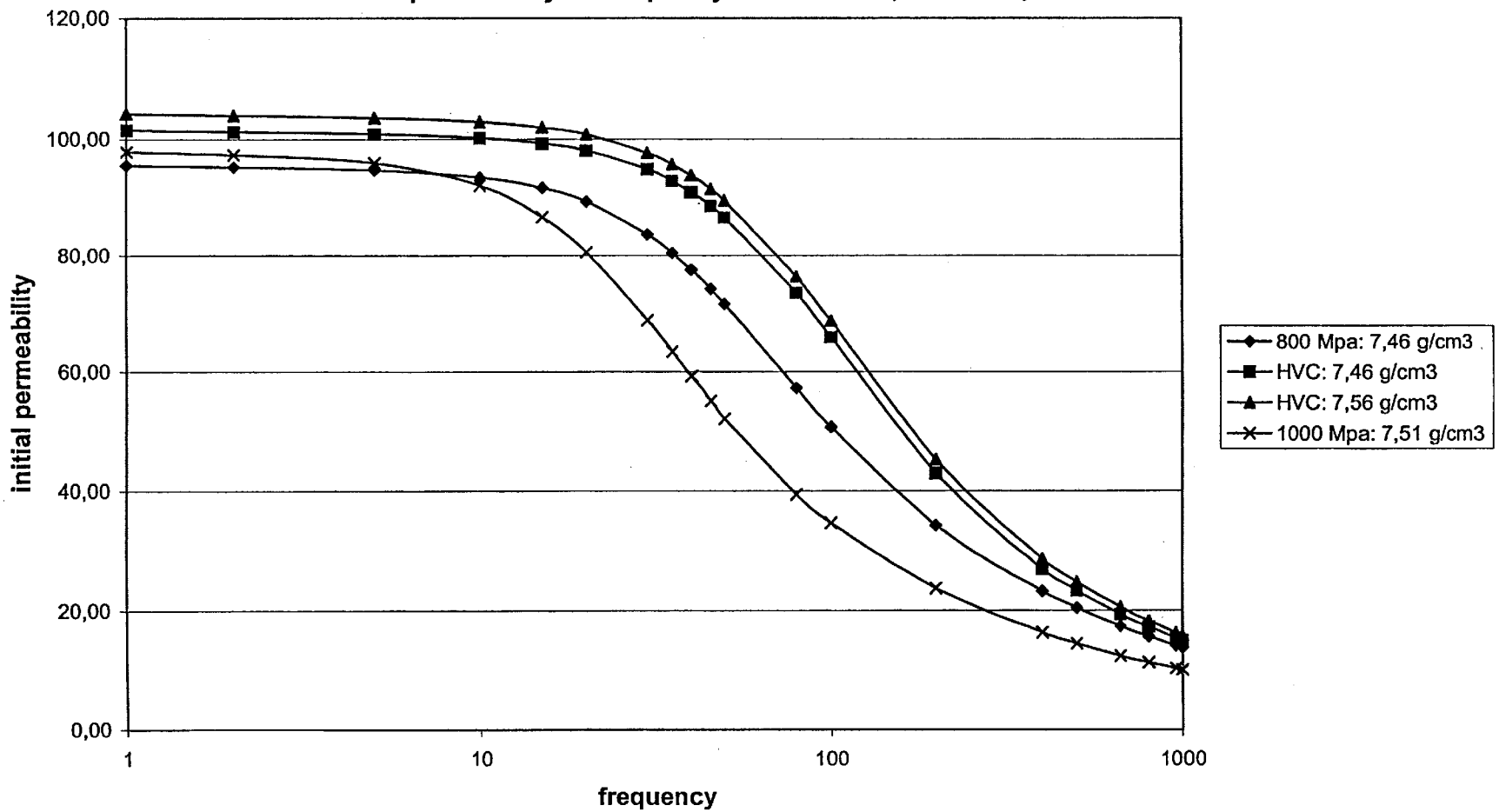
Figure 3:
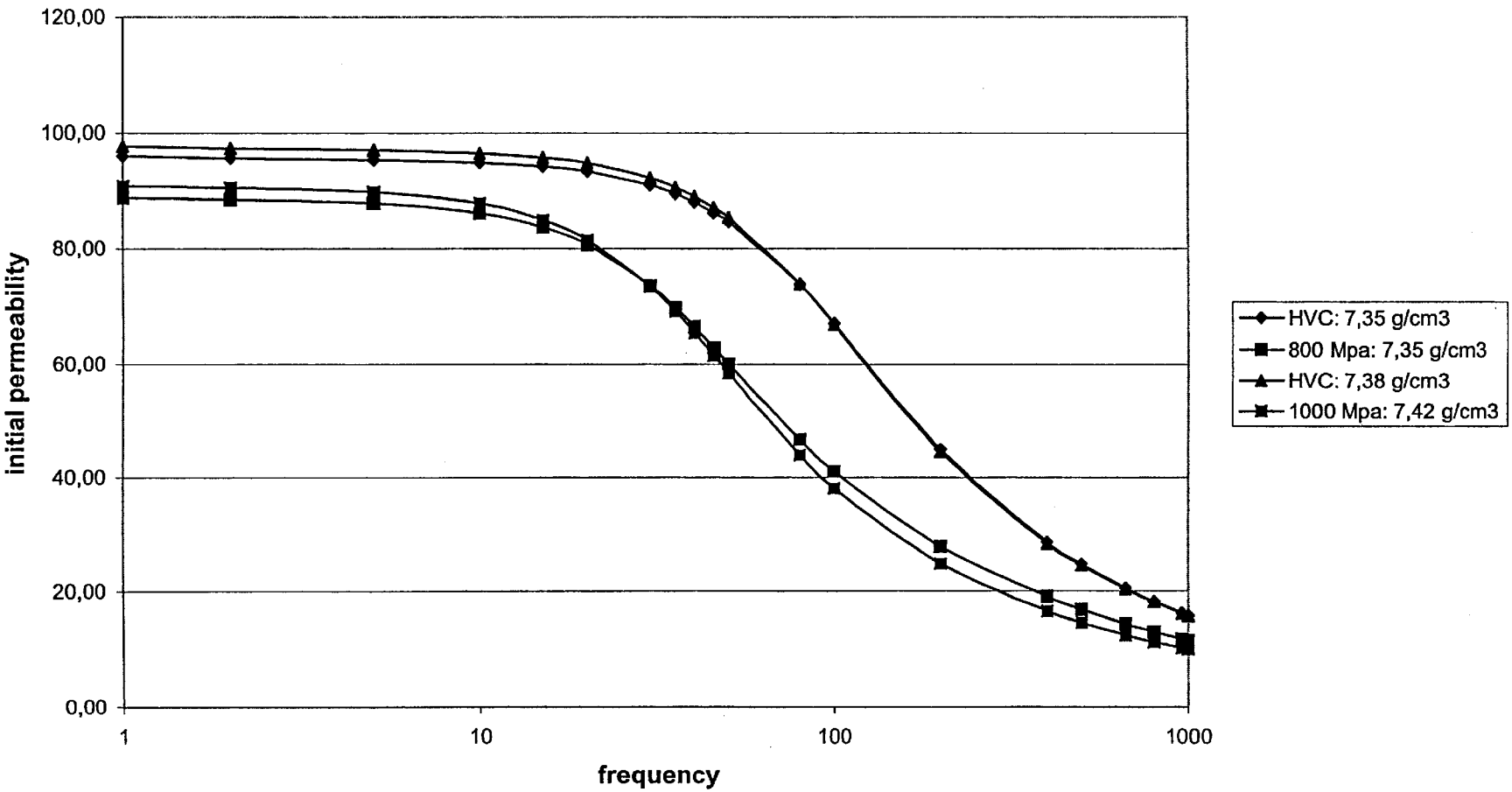

The samples have the same geometry and testing was made exactly the same way. At a given density an unexpected difference could be observed between HVC and conventional compacted samples as can be seen from FIGS. 2 and 3. 0.2 and 0.5% by weight, respectively, of a particular lubricant (Kenolube®) was added to the iron powder before the compaction. The stroke lengths used for the HVC compaction in FIG. 2 were 85 and 100 mm corresponding to ram speeds of 8 and 9 m/s, respectively. The stroke lengths used for the HVC compaction in FIG. 3 were 70 and 90 mm corresponding to ram speeds of 7.5 and 8.5 m/s, respectively.

What is claimed is:

1. Method of preparing high density compacts for soft magnetic applications in alternating magnetic fields comprising the steps of subjecting an iron or iron-based soft magnetic powder to to HVC compaction with a uniaxial pressure movement with a ram speed of at least 2 m/s.

2. Method according to claim 1 characterised in that the compaction is performed at a ram speed above 3 m/s.

3. Method according to claim 1 characterised in that the compaction is controlled by the impact energy transferred to the powder.

4. Method according to claim 1 characterised in that the compaction is performed as warm compaction.

5. Method according to claim 1 for the preparation of compacts having a density above about 96% of the theoretical density.

6. Method according to claim 1 for the preparation of compacts having a density above about 98% of the theoretical density.

7. Method according to claim 1 characterised in that the compaction is performed in a lubricated mould with internal lubricant within said powder.

8. Method according to claim 1 characterised in that the compaction is performed in a lubricated mould with internal lubricant.

9. Method according to claim 1 characterised in that the compaction is performed with a powder including at most 1% by weight of a lubricant.

10. Method according to claim 1 characterised in that the compaction is performed at a ram speed above 5 m/s.

11. Method according to claim 2 characterised in that the compaction is controlled by the impact energy transferred to the powder.

12. Method according to claim 2 characterised in that the compaction is performed as warm compaction.

13. Method according to claim 2 for the preparation of compacts having a density above about 96% of the theoretical density.

14. Method according to claim 2 for the preparation of compacts having a density above about 98% of the theoretical density.

15. Method according to claim 1 characterised in that the compaction is performed in a lubricated mould without internal lubricant being present within said powder.

16. Method according to claim 2 characterised in that the compaction is performed in a lubricated mould without internal lubricant being present within said powder.

17. Method according to claim 2 characterised in that the compaction is performed in a lubricated mould without internal lubricant.

18. Method according to claim 1 characterised in that the compaction is performed with a powder including at most 0.5% by weight of a lubricant.

19. Method according to claim 2 characterised in that the compaction is performed with a powder including at most 0.5% by weight of a lubricant.

20. Method according to claim 3 characterised in that the compaction is performed with a powder including at most 0.5% by weight of a lubricant.

* * * * *

UNITED STATES PATENT AND TRADEMARK OFFICE

CERTIFICATE OF CORRECTION

PATENT NO. : 6,503,444 B1
DATED : January 7, 2003
INVENTOR(S) : Ola Andersson

It is certified that error appears in the above-identified patent and that said Letters Patent is hereby corrected as shown below:

Title page,
Item [30], should read:

-- [30] Foreign Application Priority Data,

Jun. 13, 2001 (SE) …….. 0102103-9. --

Signed and Sealed this

Twenty-seventh Day of May, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,503,444 B1
APPLICATION NO. : 09/963633
DATED : January 7, 2003
INVENTOR(S) : Ola Andersson and Michael Stokes It is certified that error appears in the above-identified patent and that said Letters Patent is hereby corrected as shown below:

At Col. 2, line 11, delete "must" and insert --need--.

Column 6:

Add dependent Claims 21 and 22, as follows:

--21. Method according to claim 1 characterised in that the particles of the powder are electrically insulated.

22. Method according to claim 2 characterised in that the particles of the powder are electrically insulated.--

Signed and Sealed this

Twenty-ninth Day of May, 2007

JON W. DUDAS
*Director of the United States Patent and Trademark Office*